United States Patent [19]

Hanagata et al.

[11] 4,350,448

[45] Sep. 21, 1982

[54] PRINTING HEAD MOUNTING DEVICE

[75] Inventors: Takayoshi Hanagata; Atsushi Noda, both of Yokohama, Japan

[73] Assignee: Canon Kabushiki Kaisha, Tokyo, Japan

[21] Appl. No.: 149,452

[22] Filed: May 13, 1980

[30] Foreign Application Priority Data

May 29, 1979 [JP] Japan ..... 54/67158

[51] Int. Cl.[3] ..... B41J 3/20

[52] U.S. Cl. ..... 400/120; 400/175; 101/93.04; 346/76 PH

[58] Field of Search ..... 400/120, 118, 119, 174, 400/175, 298; 101/93.04; 219/216; 346/76 PH, 139 C

[56] References Cited

U.S. PATENT DOCUMENTS

| | | | |
|---|---|---|---|
| 2,895,584 | 7/1959 | Hickerson et al. | 400/175 X |
| 3,960,255 | 6/1976 | Bisson et al. | 346/76 PH |
| 3,988,744 | 10/1976 | Noda | 400/120 X |
| 4,130,752 | 12/1978 | Conta et al. | 346/76 PH |

*Primary Examiner*—Paul T. Sewell
*Assistant Examiner*—C. A. Pearson
*Attorney, Agent, or Firm*—Fitzpatrick, Cella, Harper & Scinto

[57] ABSTRACT

A printing head for use in a thermal printer or a discharge type printer has a groove formed in the side thereof, and balls or rollers are resiliently projected therewithin. When mounted on a connector resting on the carriage of the printer, the printing head is positively held at a regular mounting position.

3 Claims, 6 Drawing Figures

PRINTING HEAD MOUNTING DEVICE

BACKGROUND OF THE INVENTION

1. Field of the Invention

This invention relates to a mounting device for a printing head used in a thermal printer, a discharge type printer or an ink jet printer which is removably mountable to the body of such printer.

2. Description of the Prior Art

In printing mechanisms having a printing head, such as thermal printers or discharge type printers, the portion which most often needs replacement is the printing head. There are cases where the printing head must be replaced with a new one several times to several tens of times before the life of the printing mechanism body expires. Therefore, a construction which readily permits the replacement of the printing head portion is regarded as important.

Devices have heretofore been devised which are designed such that by inserting into a connector-like part a printing head to which an electrical signal is supplied, the head is regularly held and electrical connection is established. FIG. 1 of the accompanying drawings shows an example of the conventional printing head mounting and dismounting structure in a thermal printer. In FIG. 1, a carriage 1 is slidable with respect to a slide rail 2 by drive means, not shown, and the carriage 1 is movable over the entire width of the recording paper. The carriage 1 has a head connector 3 fixed thereto, and grooves 3' and 3'' of the body are set so as to fit to the projected portions 5' and 5'' of a thermal head 5. In the thermal head 5, reference numeral 7 designates a heating member and reference numeral 6 designates a pattern which is adapted to be in contact with the contacts 4 of the connector to transmit an electrical signal thereto. This example of the prior art readily permits replacement of the head, but it has suffered from the following serious disadvantages.

(1) Since there is no means for controlling the vertical position of the thermal head 5, the head gradually slips out of the connector during a long-time use to create a deviation of the printing position which in turn results in thinning of upper portions of printed characters. FIG. 2(A) shows a case where the head lies at its regular position, and FIG. 2(B) shows a case where the head has slipped out of the connector. In FIG. 2(A), the heating member 7 of the head 5 presses against a rubber pad 10 with recording paper 11 interposed therebetween and so, the contact between the heating member 7 and the receiving paper 11 is very good. On the other hand, in FIG. 2(B), the upper portion 7' of the heating member 7 is not pressing against the pad 10 with the recording paper 11 interposed therebetween and thus, the printed characters in this portion become extremely thin.

(2) Further, in the example of the prior art, there is some amount of backlash between the grooves 3', 3'' of the connector body and the projected portions 5', 5'' of the head and therefore, violent horizontal movement of the carriage 1 resulting from the printing operation causes the pattern 6 of the head 5 and the contacts 4 to slide against one another respectively. This has led to the danger that the contacts or the pattern become abraded thereby causing unsatisfactory contact therebetween.

SUMMARY OF THE INVENTION

It is an object of the present invention to ensure that a printing head be positively held at a regular position on a connector.

It is another object of the present invention to facilitate the removal and insertion of the printing head with respect to the connector and to improve the durability of the head for the removal and insertion thereof.

It is still another object of the present invention to eliminate the slip-out of the printing head from the connector and the horizontal backlash of the head.

The invention will become fully apparent from the following detailed description thereof taken in conjunction with the accompanying drawings.

BRIEF DISCRIPTION OF THE DRAWINGS

FIG. 1 is a perspective view of the head mounting device according to the prior art.

FIGS. 2(A) and 2(B) are cross-sectional views thereof.

DESCRIPTION OF THE PREFERRED EMBODIMENTS

Figure 1:
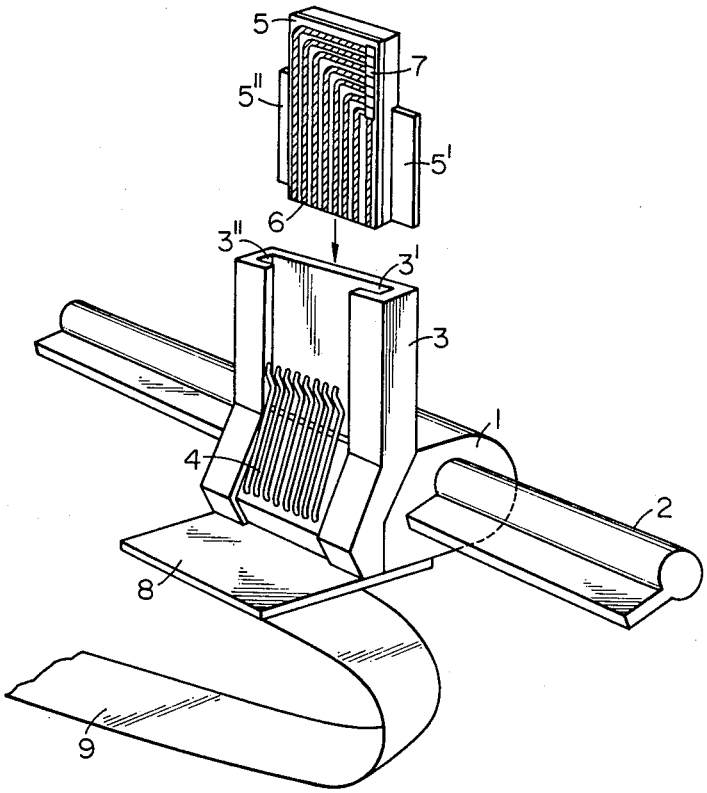
Figure 2A:
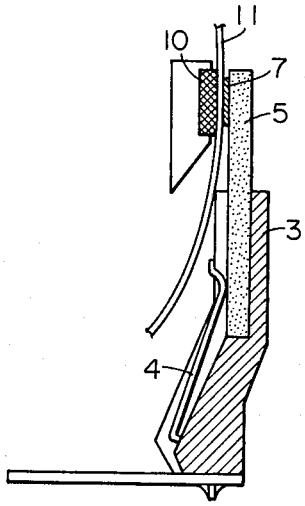
Figure 2B:
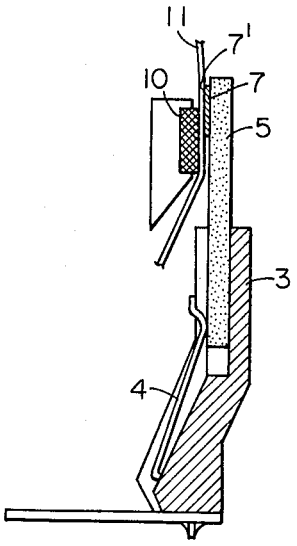
Figure 3:
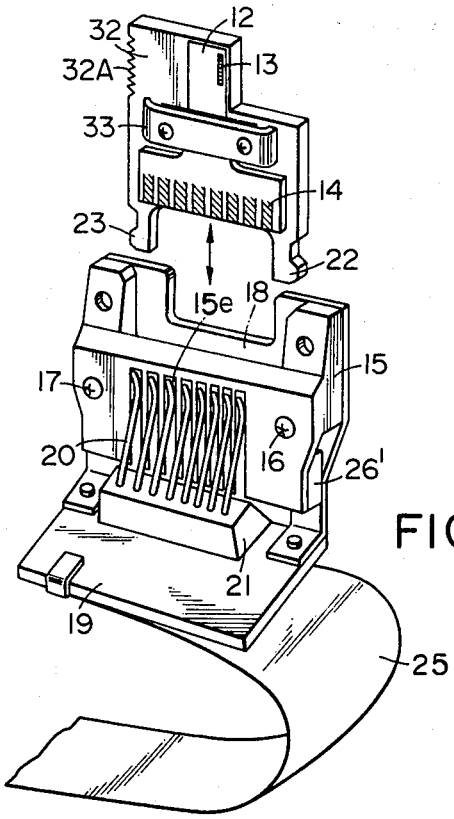
FIG. 3 is a perspective view of the head mounting device according to the present invention.
Figure 4:
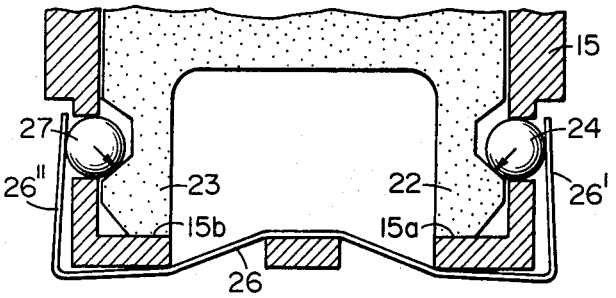
FIG. 4 is a cross-sectional view thereof.
Figure 5:
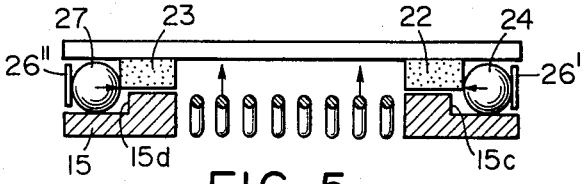
FIG. 5 is a cross-sectional view of the portion adjacent to steel balls taken at a right angle.

Referring to FIG. 3, reference numeral 12 designates a thermal head, 13 a heating member, 14 a pattern for a contact, and 32 and 33 denote members for holding the head 12. A connector body 15 is fixed to a chassis 18 by means of screws 16 and 17, and a print plate 19 is secured to the chassis 18 by means of screws. Contact pieces 20 resiliently biased against the contact pattern 14 to effect electrical connection and eliminate the backlash of the head holding member 32 in the direction of its thickness are soldered to the print plate 19. The contact pieces 20 are held at accurate positions by grooves **15*e* formed in the connector body 15. A carriage, not shown, which is secured to the chassis 18 is movable to the left and right in FIG. 3 and so, an electrical signal supplied to the heating member 13 is supplied by the print plate 19 and flexible electric wire 25. A lock mechanism is provided on the side of connector body 15 so as to correspond to leg-like portions 22 and 23 provided on the member 32 which holds the thermal head 12. FIG. 4 is a cross-sectional view of the head lock mechanism. Steel balls 24 and 27 are always biased inwardly by the opposite ends 26' and 26'' of a plate spring 26. The legs 22 and 23 of the head holding member 32 have their bottom surface bearing against support portions 15*a* and 15*b* of the bottom surface of the connector body 15, whereby the member 32 is fixed against downward movement. The steel balls 24 and 27 fit in grooves of trapezoidal cross-section provided in the other sides of the legs 22 and 23 and make substantially point contact with one surface of each said groove to transmit the bias force of the plate spring 26 thereto. FIG. 5 is a sectional view of the portion adjacent to the steel balls 24, 27 taken along a right angle direction. When the legs 22 and 23 of the head are not yet inserted, the steel balls 24 and 27 are inwardly biased by the plate spring 26 so as to bear against and be stopped by portions 15*c* and 15*d*, respectively, of the connector body. When the head is inserted, the steel balls 24 and 27 are forced apart and subsequently into the grooves, as is shown in FIG. 4. Forces imparted to the head by the steel balls 24 and 27 are in the directions indicated by arrows in the drawing. When the head is completely inserted the legs 22 and 23 of the head are restrained by the portions 15***a* and 15*b* of the connector body, and are thereby locked in the vertical direction, and are also pushed by the steel balls 24 and 27 from the opposite sides, thus being also positively locked in the horizontal direction. In FIG. 5, pressure force is exerted in the direction of arrows by the contact pieces 20, thus eliminating any backlash in this direction. A great difference of the head connector from other usual connectors is that in the case of the head connector, the connector body is mounted to the carriage and its horizontal vibration is violently repeated and a friction force is imparted to the head by the recording paper. That is, in the case of this head connector as compared with other connectors, a problem in terms of its durability occurs unless the head is locked with a much greater force. According to the present invention, the following benefits are obtained by using steel balls in this lock mechanism. That is, the substantial point contact effected between the steel balls 24, 27 and the head legs 22, 23, between the steel balls and the plate spring ends 26', 26'' and between the steel balls and portions of the connector body 15 leads to the following effects:

1. Little or no friction force is exerted between the steel balls and the head and between the steel balls and the plate spring ends and therefore, the force of the plate spring is effectively exerted on the head.

2. Little or no friction force is exerted as mentioned under item 1 above and therefore, the head can be withdrawn with substantially the same force as the holding force.

3. Even repeated removal and insertion causes little or no wear.

4. The lock mechanism according to the present invention has no play. In the case of a head connector, the presence of the slightest play would cause sliding movement in that portion and this may in turn cause unsatisfactory contact. The present invention entirely eleminates such an undesirable possibility.

The shown embodiment of the present invention uses steel balls, but may also use rollers. The balls or rollers may also be made of a hard material such as hard non-ferrous metal or plastics to obtain the same effect. Also, the legs 22 and 23 may be formed by extending the head 12 itself.

What we claim is:

1. A printing head mounting device comprising:

head means having at least one groove formed in each side surface of said head means and integrally holding a heating member with a pattern of electrical contacts to supply an electrical signal to said heating member;

a connector body for removably holding said head means in a direction substantially vertical to a direction of movement of said head means when said means prints a line of characters with the direction of said head means determined when a bottom surface of said head means is held on a bottom surface of said connector body;

a plurality of electrically conductive contact pieces held at accurate positions by at least one groove formed in said connector body to make electrical connection with said pattern of said head means;

a plurality of rotatable members fitting in the grooves of said head means and pressing a bottom surface of said head means against a bottom surface of said connector body; and;

a resilient member for biasing said plurality of rotatable members towards each other and in a direction substantially parallel to the direction of movement of said head means.

2. A printing head mounting device according to claim 1, wherein each of the grooves of said head means has a trapezoidal-like cross-section and each of said rotatable members makes point contact with one surface of each of the grooves of said head means.

3. A printing head mounting device according to claim 1 or 2, wherein each of the grooves of said head means is provided opposite to each other in the opposing sides of said head means, and wherein each one of said rotatable members fits in a separate one of the grooves of said head means and their mutual operation eliminates any other force except for pressure force exerted to press the bottom surface of said head means against the bottom surface of said connector body.

* * * * *